US005709013A

United States Patent [19]

Stanback

[11] Patent Number: 5,709,013

[45] Date of Patent: Jan. 20, 1998

[54] ORNAMENT SUPPORT DEVICE

[76] Inventor: Alicia Stanback, 4349 Elkhorn Blvd. No. 177, Sacramento, Calif. 95842

[21] Appl. No.: 660,010

[22] Filed: Jun. 3, 1996

[51] Int. Cl.[6] ..... A44B 9/00

[52] U.S. Cl. ..... 24/66.9; 24/66.11; 132/273; 63/29.1

[58] Field of Search ..... 24/66.9, 66.11, 24/115 H, 54, 58, 3.13, 66.6, 66.2, 113 MP; 2/207; 63/20, 29.1, 15.3, 1.1, 2, 21; 132/273, 275, 276, 278

[56] References Cited

U.S. PATENT DOCUMENTS

| | | | |
|---|---|---|---|
| D. 31,544 | 9/1899 | Bagnall | 63/2 X |
| 211,558 | 1/1879 | Edwards | 63/15.3 X |
| 2,488,954 | 11/1949 | Winters | 132/275 |
| 3,639,949 | 2/1972 | Beck | 24/66.11 |
| 3,751,769 | 8/1973 | Reiner | 132/273 X |
| 4,038,724 | 8/1977 | Parizek | 24/66.9 |
| 5,052,083 | 10/1991 | Hammer | 24/66.2 |
| 5,097,854 | 3/1992 | Smith | 132/273 X |
| 5,165,257 | 11/1992 | Corenblith | 63/1.1 |

FOREIGN PATENT DOCUMENTS

| | | | |
|---|---|---|---|
| 14224 | of 1898 | United Kingdom | 63/21 |

*Primary Examiner*—Peter M. Cuomo
*Assistant Examiner*—Hanh V. Tran
*Attorney, Agent, or Firm*—Bielen, Peterson & Lampe

[57] ABSTRACT

A device for confining an ornament possessing a pin fastener to a piece of material utilizing a base member which is adapted to lie adjacent the backside of the ornament. The base member is attachable to the pin fastener of the ornament and is linked to a support which holds the base member to the piece of material.

8 Claims, 1 Drawing Sheet

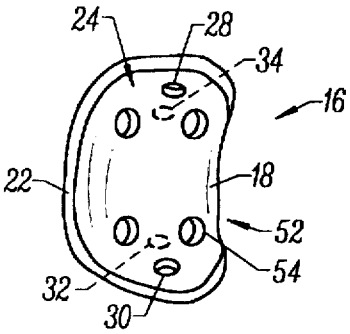
FIG. 1
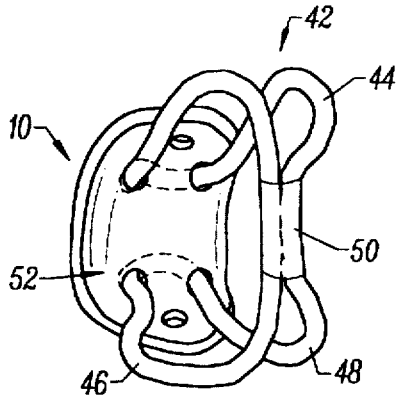
FIG. 2
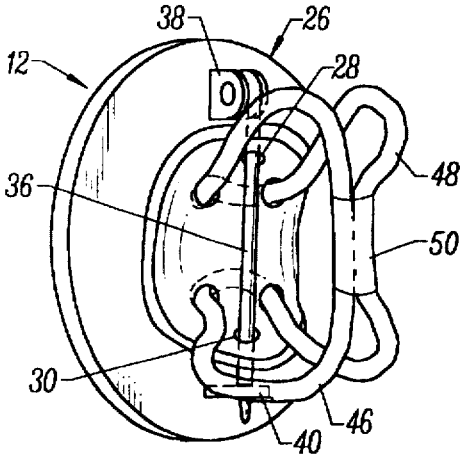
FIG. 3
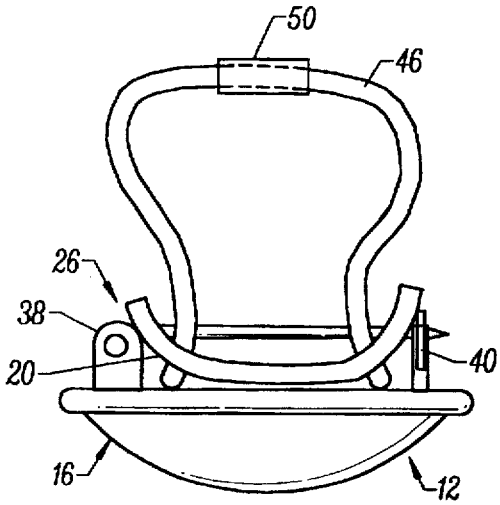
FIG. 4
FIG. 5
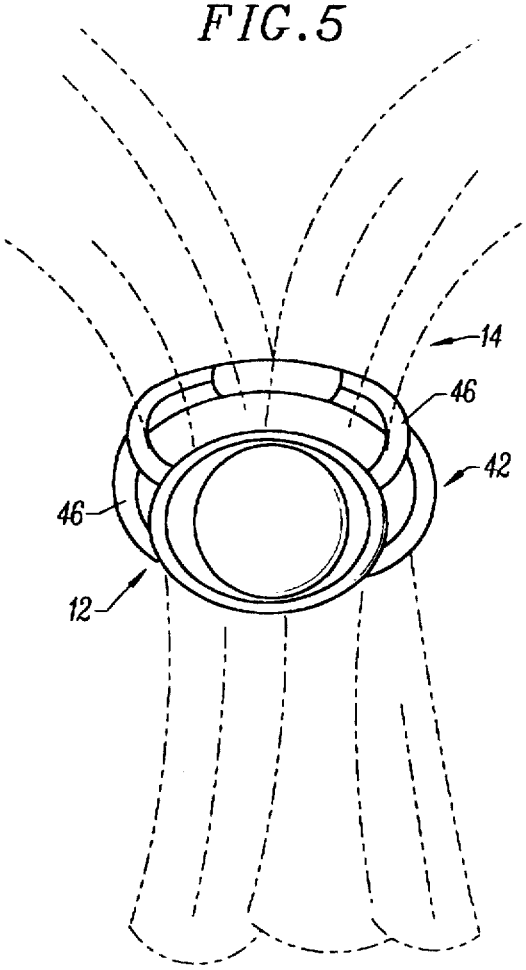

ORNAMENT SUPPORT DEVICE

CROSS REFERENCES TO RELATED APPLICATIONS

BACKGROUND OF THE INVENTION

The present invention relates to a device for confining a ornament having a pin fastener to a piece of material.

In the past, ornaments such as jewelry, including pendants, broaches, ornamental pins, and the like are normally fastened to a piece of material such as an article of clothing by the use of a pin fastener. Typically, the pin fastener includes an elongated pin section and a lock which prevents the pin from rotating and moving once the pin has penetrated the article of clothing. Unfortunately, pin fasteners tend to damage articles of clothing, especially scarves, ties, and other materials which are of fine quality.

Other means of fastening an ornamental article such as jewelry to a piece of material have been devised. These include adhesives, magnets, and the like. In general, it has been found that alternate means of fastening jewelry to a piece of material are either ineffective or damage the material in some manner.

An ornamental article having a pin fastener which may be alternately fastened to a piece of material without permitting the pin fastener to penetrate the material would be a notable advance in the fashion industry.

SUMMARY OF THE INVENTION

In accordance with the present invention a novel and useful device for confining an ornamental article such as jewelry having a pin fastener to a piece of material is herein provided.

The device of the present invention uses a base member which is capable of lying adjacent the backside of the ornamental article or jewelry item. The base member includes an attachment means for engaging the pin fastener. For example, such attachment means may take the form of a plurality of bores or holes through the base member which serves to anchor the pin fastener. Thus, the plurality of bores are capable of fastening or accommodating a fastening pin of a certain size. The base member may be a flexible or resilient member possessing the capability of conforming to the backside of the ornamental article.

Support means is also found in the present invention for holding the base member to the piece of material. The support means may include linking means for connecting the support means to the base member. In certain cases, the support means may take the form of at least one elongated member which possesses elasticity. The elongated member may be formed into a pair of closed loops which extend from the base member in side-by-side configuration. The pair of loops may be stabilized by the use of a clasp or fastener which holds the pair of loops together. Thus, the pair of loops are easy to manage when engaging the piece of material such as a scarf, tie, belt, and the like to which the ornamental article is attached.

Linking means for connecting the support means to the base member is also included in the present invention and may include a multiplicity of openings through the base member spaced from the plurality of bores intended to accommodate the locking or fastening pin. Thus, a pin fastened ornamental article may be attached to a piece of material without employing the pin to penetrate the material.

It may be apparent that a novel and useful device for confining an ornamental article having a pin fastener to a piece of material has been described.

It is therefore an object of the present invention to provide a device for confining an ornamental pin fastened article to a piece of material which achieves this result without the pin fastener puncturing the piece of material.

Another object of the present invention is to provide a device for confining a pin fastened ornamental article to a piece of material which is adaptable to articles of jewelry of various sizes and shapes.

A further object of the present invention is to provide a device for confining a pin fastened ornamental article to a piece of material which may be used on various pieces of jewelry or ornamental articles in interchangeable fashion.

Another object of the present invention is to provide a device for confining a pin fastened ornamental article to a piece of material which is not visible after fastening.

The invention possesses other objects and advantages especially as concerns particular characteristics and features thereof which will become apparent as the specification continues.

BRIEF DESCRIPTION OF THE DRAWINGS

FIG. 1 is a top right rear perspective view of the base member portion of the present invention.

FIG. 2 is a perspective view of the base member and support means portions of the present invention.

FIG. 3 is a perspective view depicting the device of the present invention in place on an ornamental article.

FIG. 4 is a side elevational view of the depiction of the device in FIG. 3.

FIG. 5 is a perspective view of an ornamental article having the device of the present invention attached thereto and in place on a piece of material.

For a better understanding of the invention reference is made to the following detailed description of the preferred embodiments which should be taken in conjunction with the hereinbefore described drawings.

DETAILED DESCRIPTION OF THE PREFERRED EMBODIMENTS

Various aspects of the present invention will evolve from the following detailed description of the preferred embodiments thereof which should be taken together with the prior described drawings.

The invention as a whole is depicted in the drawings by reference character 10. The device 10 intended to confine an ornamental article such as a broach 12, FIG. 3 to a piece of material 14, FIG. 5. With reference to FIG. 1, it may be observed that device 10 possesses a base member 16 which may be formed of any suitable material. Preferably, base member 16 is formed of a flexible resilient material such as an elastomer, including rubber, plastic, fiber, and the like. Base member 16 is thus able to conform to space afforded by broach 12, which will be discussed in greater detail hereinafter. In addition, base member 16 may be transparent to minimize the visibility of device 10 when in use. Base member 16 includes front side 18, backside 20, FIG. 4, and an endless edge portion 22.

Means 24 is also found in the present invention for engaging pin fastener 26 of broach 12. Means 24 may take the form of bores 28 and 30 which extend through base member 16. Bores 32 and 34, shown in phantom on FIG. 1, may also be formed through base member 16 to accommodate pin fasteners of different size and/or configuration. FIG. 3 illustrates pin fastener 26 having elongated pin 36, which rotates about base 38 and is confined by lock 40.

Device 10 is also provided with support means 42 for holding base member 16, and attached broach 12, to piece of material 14. Support means 42 includes an elongated member 44 which is in the form of an elastic band or loop. Band 44 may be formed into a pair of loops 46 and 48, FIG. 2, that extend outwardly from front side 18 of base member 16. Clasp or fastener 50 hold loops 46 and 48 together for the sake of stability and ease of use.

Linking means 52, best shown in FIGS. 1 and 2, connects support means 42 to base member 16. Linking means 52 takes the form of a plurality of openings 54 (four openings depicted in FIGS. 1 and 2) which lie outside of openings 28 and 30. Thus, pin 36 does not interfere with loops 46 and 48 when emplaced.

In operation, the user slips pin 36 of broach 12 through openings 28 and 30 in order to activate attachment means 24. Link pin 36 is held in its closed position by holder 40, loops 46 and 48 are slipped over piece of material 14 to permit broach 12 to be viewed as shown in FIG. 5. This process is reversed to remove device 10 from piece of material 14. Device 10 may be interchanged with different ornamental articles similar to broach 12. The flexibility of base member 16 permits variability in the length of pin 12 as far as the use of device 10 is concerned. In certain cases, device 10 must be particularly sized to accommodate certain ornamental articles that do not properly fit the size of base members shown in the drawings. In essence, device 10 prevents pin 36 from penetrating piece of material 14 which can be undesirable when material 14 possesses a fineness such as that afforded by silk. While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A device for confining an ornamental article, having a pin fastener, to a piece of material comprising:

a. a base member, said base member lying adjacent the backside of the ornamental article and including attachment means for engaging the pin fastener, said base member being constructed of flexible material, said attachment means including at least one bore through said base member for passing of the pin fastener therethrough, and b. support means for holding said base member to the piece of material, said support means including linking means for connecting said support means to said base member.

2. The device of claim 1 in which said attachment means for engaging the pin fastener includes a plurality of bores through said base member.

3. The device of claim 1 in which said support means comprises an elongated member possessing elasticity.

4. The device of claim 3 in which said elongated member forms into a pair of closed loops.

5. The device of claim 4 which additionally comprises a clasp holding said pair of loops together.

6. The device of claim 3 in which said linking means further includes a multiplicity of openings in said base member for accommodating said elongated member.

7. The device of claim 6 in which said linking means further includes a multiplicity of openings in said base member for accommodating said elongated member.

8. The device of claim 6 in which said multiplicity of openings of said linking means lie outside of said plurality of bores of said attachment means to permit the pin fastener to pass between said pair of closed loops.

* * * * *